US006587024B2

(12) United States Patent
Matsumoto

(10) Patent No.: US 6,587,024 B2
(45) Date of Patent: Jul. 1, 2003

(54) ELECTROMAGNETIC COIL ASSEMBLY FOR ELECTROMAGNETIC APPARATUS

(75) Inventor: Hideyuki Matsumoto, Isesaki (JP)

(73) Assignee: Sanden Corporation, Gunma (JP)

( * ) Notice: Subject to any disclaimer, the term of this patent is extended or adjusted under 35 U.S.C. 154(b) by 86 days.

(21) Appl. No.: 09/788,368

(22) Filed: Feb. 21, 2001

(65) Prior Publication Data

US 2001/0017583 A1 Aug. 30, 2001

(30) Foreign Application Priority Data

Feb. 29, 2000 (JP) ..... 2000-057931

(51) Int. Cl.[7] ..... H01F 27/30
(52) U.S. Cl. ..... 336/198; 336/192; 335/289
(58) Field of Search ..... 336/65, 192, 197, 336/198, 196, 208, 107; 335/289, 278

(56) References Cited

U.S. PATENT DOCUMENTS

| | | | | |
|---|---|---|---|---|
| 3,130,355 A | | 4/1964 | Younger | |
| 3,585,450 A | | 6/1971 | Lane | |
| 4,181,393 A | | 1/1980 | Lill | |
| 4,404,534 A | | 9/1983 | Janvrin | |
| 4,419,536 A | | 12/1983 | Doyle et al. | |
| 4,429,358 A | | 1/1984 | Miyagi | |
| 4,432,446 A | | 2/1984 | Okano et al. | |
| 4,503,413 A | | 3/1985 | Stalzer | |
| 4,557,544 A | | 12/1985 | Esser | |
| 4,623,754 A | | 11/1986 | Kikuchi et al. | |
| 4,771,198 A | | 9/1988 | Aschberger et al. | |
| 4,799,578 A | | 1/1989 | Matsushita | |
| 4,935,713 A | | 6/1990 | Bekheeet | |
| 5,121,093 A | | 6/1992 | Matsushita | |
| 5,138,293 A | | 8/1992 | Ishimaru | |
| 5,225,801 A | | 7/1993 | Ida et al. | |
| 5,307,038 A | | 4/1994 | Ishimaru | |
| 5,320,206 A | | 6/1994 | Maejima | |
| 5,508,671 A | * | 4/1996 | Takashi | 336/192 |
| 5,889,455 A | | 3/1999 | Sakamoto | |
| 6,069,547 A | | 5/2000 | Sakamoto | |
| 6,091,590 A | | 7/2000 | Sakamoto | |

FOREIGN PATENT DOCUMENTS

| | | |
|---|---|---|
| EP | 0422962 | 4/1991 |
| EP | 0741254 | 11/1996 |
| EP | 0834888 | 4/1998 |
| GB | 2234329 | 1/1991 |
| GB | 2248969 | 4/1992 |
| JP | 56138529 | 10/1981 |
| JP | 2106007 | 4/1990 |
| JP | 08247171 | 9/1996 |

* cited by examiner

*Primary Examiner*—Tuyen T. Nguyen
(74) *Attorney, Agent, or Firm*—Baker Botts L.L.P.

(57) ABSTRACT

An electromagnetic coil assembly for an electromagnetic apparatus has a bobbin, a coil formed of an electrical wire wound a spool of the bobbin, a thermal protection device including a pair of lead wires, a first and a second lead wires, extending from thereof. The first lead wire is connected to one end of the electrical wire through a first connecting member. The second lead wire is connected to one end of a lead wire of an electric circuit through a second connecting member. At least one securing member having a groove-shaped cross-section is secured, e.g., welded securely or fittied pressedly, on a first end surface of the bobbin. The thermal protection device, the first connecting member, and the second connecting member are disposed on the first end surface of the bobbin and are covered by the securing member.

7 Claims, 8 Drawing Sheets

ELECTROMAGNETIC COIL ASSEMBLY FOR ELECTROMAGNETIC APPARATUS

BACKGROUND OF THE INVENTION

1. Field of the Invention

The present invention relates to an electromagnetic coil assembly for use in an electromagnetic apparatus, such as an electromagnetic clutch for use in controlling the transmission of power from an automobile engine to a refrigerant compressor in an automobile air conditioning system. More particularly, it relates to the mounting structure for a thermal protection device, electrical wires, and caulking terminals in the electromagnetic coil assembly.

2. Description of Related Art

Referring to FIGS. 1 and 2, an electromagnetic coil assembly 4, which comprises a bobbin 1 and a coil 3, is known in the art. Bobbin 1 has a toroidal shape having a spool portion, which has an exterior open edge. Coil 3 is formed of electrical wire 2, which is wound around the spool portion. An electromagnetic coil assembly 4, for example, is used in an electromagnetic clutch 6 of a compressor 5 in an automobile air conditioning system, as shown in FIG. 3. Electromagnetic coil assembly 4 may be provided with a thermal protection device 7, e.g., a thermal fuse or a thermal switch, which is sensitive to high temperatures in electromagnetic clutch 6. Thermal protection device 7 isolates a power source, such as an automobile engine, to protect electromagnetic clutch 6 and compressor 5 when high temperatures due to friction are generated between the parts in electromagnetic clutch 6.

Referring again to FIGS. 1 and 2, thermal protection device 7 has a pair of leads, a first lead 7*a* and a second lead 7*b*, extending from either end of thermal protection device 7. An end of first lead 7*a* of thermal protection device 7 is connected to a wire end portion 2*a* of electrical wire 2 through a first caulking terminal 8. An end of second lead 7*b* of thermal protection device 7 is connected to a third lead 9, which is connected to the external power source (not shown), through a second caulking terminal 10. Thermal protection device 7, first lead 7*a* and second lead 7*b*, wire end portion 2*a*, and third lead 9 are disposed on a first end surface 1*a* of bobbin 1. A securing member 11 having a groove-shaped cross-section is fixed securely on first end surface 1*a* by adhesives. Thermal protection device 7 is fitted into the groove-shaped portion of securing member 11. A pair of projection portions 12*a* and 12*b* are formed on first end surface 1*a*. First lead 7*a* and second lead 7*b* are fixeded to projection portions 12*a* and 12*b*, respectively. Consequently, thermal protection device 7, as well as first caulking terminal 8 and second caulking terminal 10, is fixed to first end surface 1*a* of bobbin 1.

As shown in FIG. 1, electromagnetic coil assembly 4 is inserted into a core 5 ring 13 having a groove-shaped cross-section and a toroidal shape in plan view, such that thermal protection device 7 on first end surface 1*a* is positioned in an open end of core ring 13. Thereafter, a resin 14 is poured into the open end of core ring 13, and electromagnetic coil assembly 4 is fixed within core ring 13.

In electromagnetic coil assembly 4, the retention strength of thermal 40 protection device 7, first caulking terminal 8, and second caulking terminal 10 within core ring 13 is relatively low. Therefore, resin 14 may enter into the spaces between thermal protection device 7, first caulking terminal 8, and second caulking terminal 10 and first end surface 1*a* of bobbin 1. Consequently, thermal protection device 7, first caulking terminal 8, and second caulking terminal 10 may be pushed upward by resin 14 entering into the spaces between these elements, and as a result, these elements may not be covered by resin 14 and may be exposed outside core ring 13. Thus, when electromagnetic coil assembly 4 disposed in core ring 13 is equipped with the parts, which comprise, for example, electromagnetic clutch 6, defects or damage may occur at thermal protection device 7, first caulking terminal 8, and second caulking terminal 10.

SUMMARY OF THE INVENTION

An object of the present invention is to reduce or eliminate the above-mentioned defects or damage, which may be encountered in known electromagnetic coil assemblies with thermal protection devices and caulking terminals.

In an embodiment of the present invention, an electromagnetic coil assembly for an electromagnetic apparatus comprises a bobbin, a coil, and a thermal protection device. The bobbin comprises a cylindrical tubular spool, and a pair of annular flanges projecting radially from the spool to form an exterior open edge. The coil is formed of an electrical wire. The electrical wire is wound around the spool between the flanges. The thermal protection device has a first and a second lead wires, each extending from one side thereof. The first lead wire is connected to one end of the electrical wire through a first connecting member. The second lead wire is connected to one end of a third lead wire of an electrical circuit through a second connecting member. The thermal protection device, the first lead wire, the second lead wire, the first connecting member, the second connecting member, and one end of the electrical wire, one end of the third lead wire are disposed and fixed on a first end surface of the bobbin. At least one securing member having a groove-shaped cross-section is fixed, e.g., welded securely or fitted pressedly, on the first end surface of the bobbin. The thermal protection device, the first connecting member, and the second connecting member are covered by the securing member.

Other objects, features, and advantages will be apparent to persons of ordinary skill in the art from the following description of the invention with reference to the accompanying drawings.

BRIEF DESCRIPTION OF THE DRAWINGS

The present invention may be more readily understood with reference to the following drawings, in which.

DETAILED DESCRIPTION OF PREFERRED EMBODIMENTS

Figure 1:
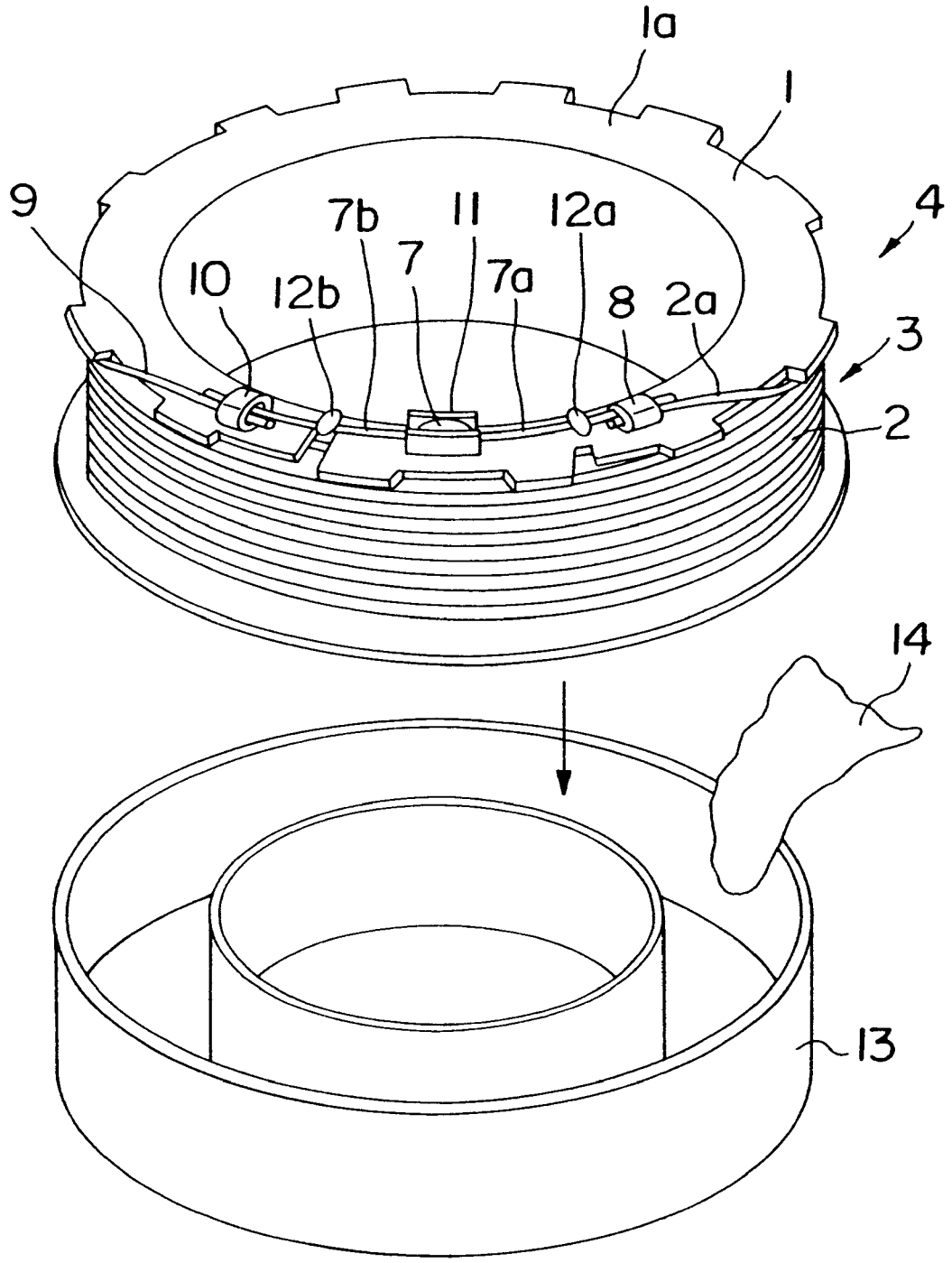
FIG. 1 PRIOR ART
FIG. 1 is a perspective and exploded view of a known electromagnetic coil assembly and core ring.
Figure 2:
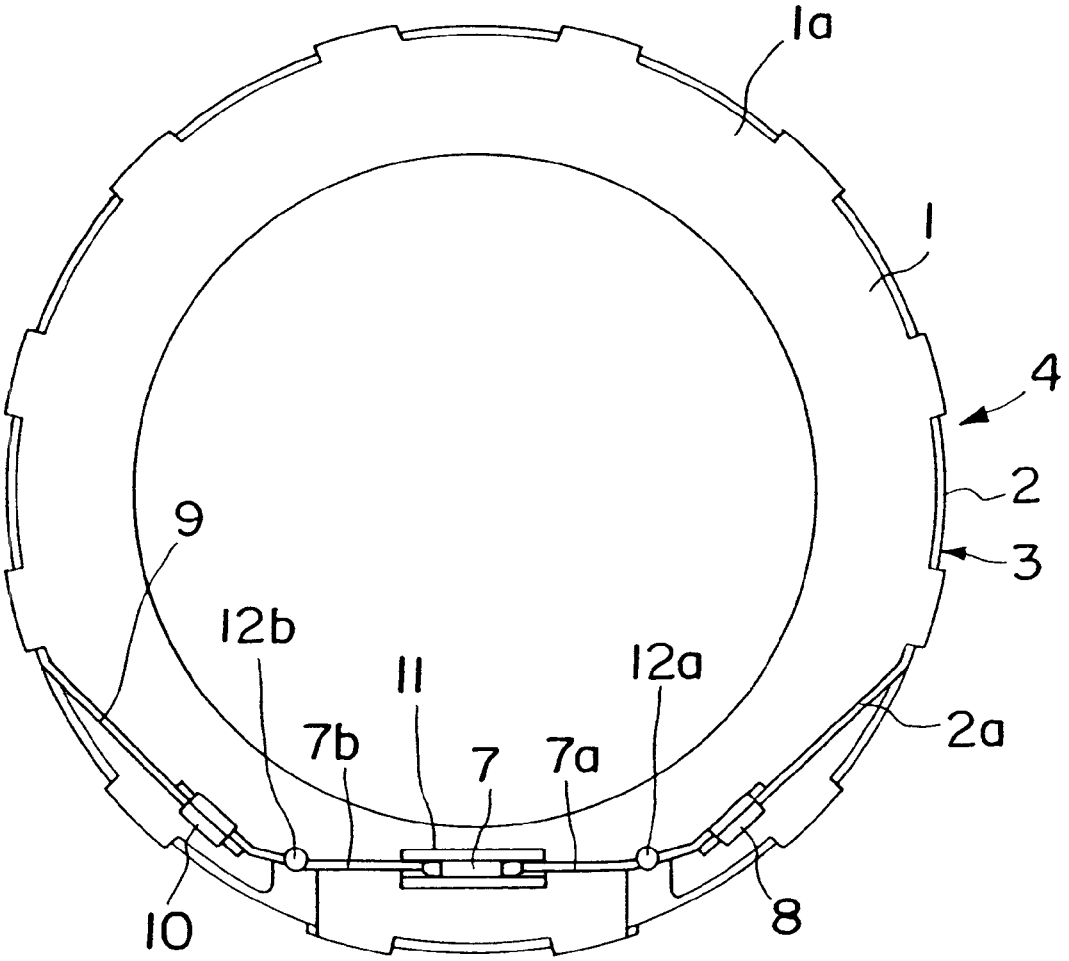
FIG. 2 PRIOR ART
FIG. 2 is a plan view of a first end surface of a bobbin of the known electromagnetic coil assembly.
Figure 3:
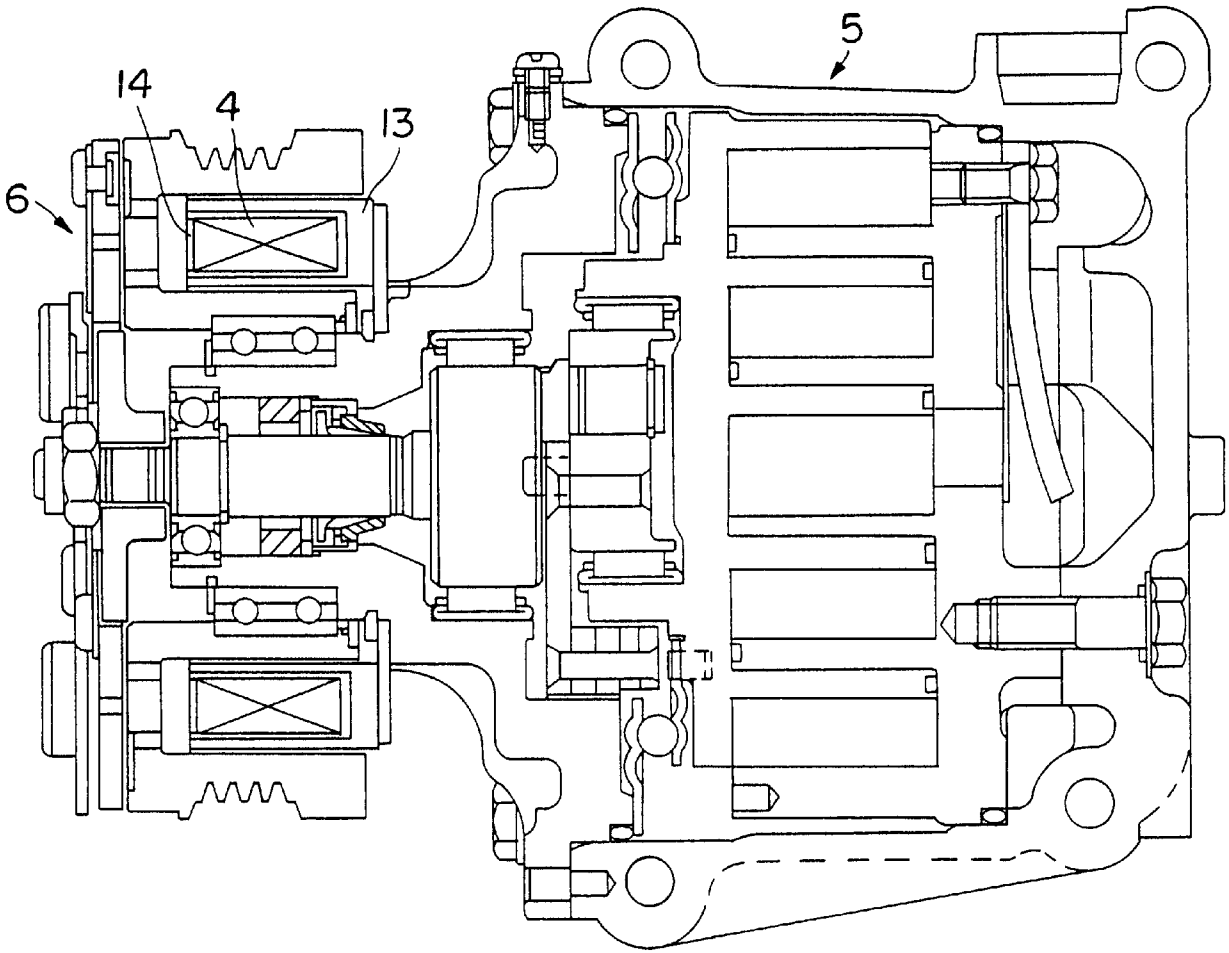
FIG. 3 PRIOR ART
FIG. 3 is a longitudinal, cross-sectional view of a known compressor for use in an automotive air-conditioning system, which includes an electromagnetic clutch having an electromagnetic coil assembly.
Figure 4:
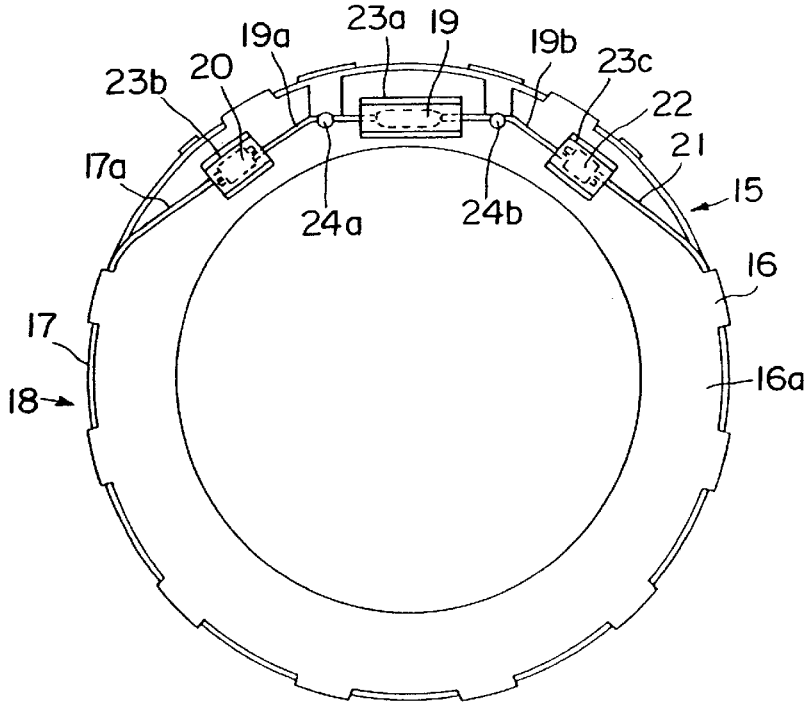
FIG. 4 is a plan view of a first end surface of a bobbin of an electromagnetic coil assembly, according to a first embodiment of the present invention.
Figure 5A:
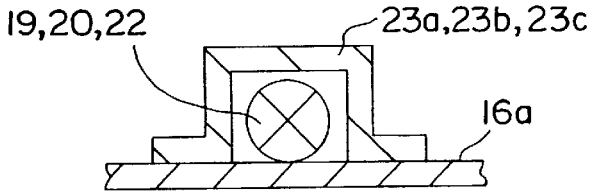
FIGS. 5*a*–5*b* are cross-sectional views of securing members depicted in FIG. 4.
Figure 5B:
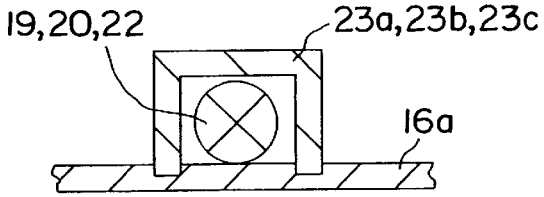
Figure 6:
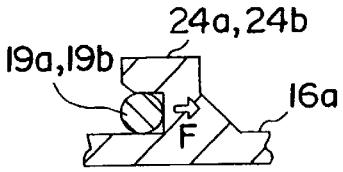
FIG. 6 is a cross-sectional view of projection portions depicted in FIG. 4.

Referring to FIGS. 4–6, an electromagnetic coil assembly of a first embodiment of the present invention is shown. An electromagnetic coil assembly 15 comprises a bobbin 16, a coil 18, a thermal protection device 19 (e.g., a thermal fuse or a thermal switch), a first caulking terminal 20, and a second caulking terminal 22. Bobbin 16 has a spool portion, which has an exterior open edge formed by two annular flange on the spool portion. Coil 18 is formed of an electrical wire 17, which is wound around the spool portion of bobbin 16. Thermal protection device 19 has a pair of leads, a first lead 19*a* and a second lead 19*b*, each extending from one end of thermal protection device 19. An end of first lead 19*a* of thermal protection device 19 is connected to a wire end portion 17*a* of electrical wire 17 through first caulking terminal 20. An end of second lead 19*b* of thermal protection device 19 is connected to one end portion of a third lead 21, which is connected to the external power source (not shown), through second caulking terminal 22. Thermal protection device 19, first caulking terminal 20, second caulking terminal 22, first lead 19*a*, second lead 19*b*, wire end portion 17*a*, and third lead 21 are disposed on a first end surface 16*a* of bobbin 16. Another end portion of third lead 21 is wound around the spool portion of bobbin 16.

Securing members 23*a*, 23*b*, and 23*c* having a groove-shaped cross-section are welded securely on first end surface 16*a* of bobbin 16, as shown in FIG. 5*a*, or are fitted pressedly on first end surface 16*a* of bobbin 16, as shown in FIG. 5*b*. Securing members 23*a*, 23*b*, and 23*c* are fixed on first end surface 16*a* of bobbin 16, which made of resin. For example, securing members 23*a*, 23*b*, and 23*c* may be fixed to bobbin 16 by high frequency welding. Thermal protection device 19, first caulking terminal 20, and second caulking terminal 22 are covered by securing members 23*a*, 23*b*, and 23*c*, respectively.

Referring again to FIG. 4, projection portions 24*a* and 24*b* are disposed on first end surface 16*a* of bobbin 16. First lead 19*a* and second lead 19*b* are secured to projection portions 24*a* and 24*b*, respectively. As shown in FIG. 6, projection portions 24*a* and 24*b*, each has a hook shape and are molded (e.g., integrally molded) with first end surface 16*a* of bobbin 16. The thickness of each of projection portions 24*a* and 24*b* gradually increases towards its base.

Electromagnetic coil assembly 15 is inserted into a core ring (not shown) having a groove-shaped cross-section and a toroidal shape in plan view, such that thermal protection device 19 on first end surface 16*a* is positioned in an open end of the core ring. Thereafter, a resin is poured into the open end of the core ring, and electromagnetic coil assembly 15 is fixed within the core ring.

In the electromagnetic coil assembly according to the first embodiment of present invention, thermal protection device 19, first caulking terminal 20, and second caulking terminal 22 are covered by securing members 23*a*, 23*b*, and 23*c*, respectively. Therefore, after electromagnetic coil assembly 15 is fixed within the core ring by using resin, the exposure of thermal protection device 19, first caulking terminal 20, and second caulking terminal 22 from the resin bath may be reduced or effectively eliminated. Tensile force is added to first lead 19*a*, second lead 19*b*, wire end portion 17*a* of electrical wire 17, and third lead 21. Therefore, the reaction force F is transferred from first lead 19*a* and second lead 19*b* to projection portions 24*a* and 24*b*, which retain first lead 19*a* and second lead 19*b*, as shown in FIG. 6. Consequently, projection portions 24*a* and 24*b* may be reinforced to have thicknesses gradually increasing towards their bases, so that the deformations of projection portions 24*a* and 24*b* by the reaction force F are reduced or eliminated.

Figure 7:
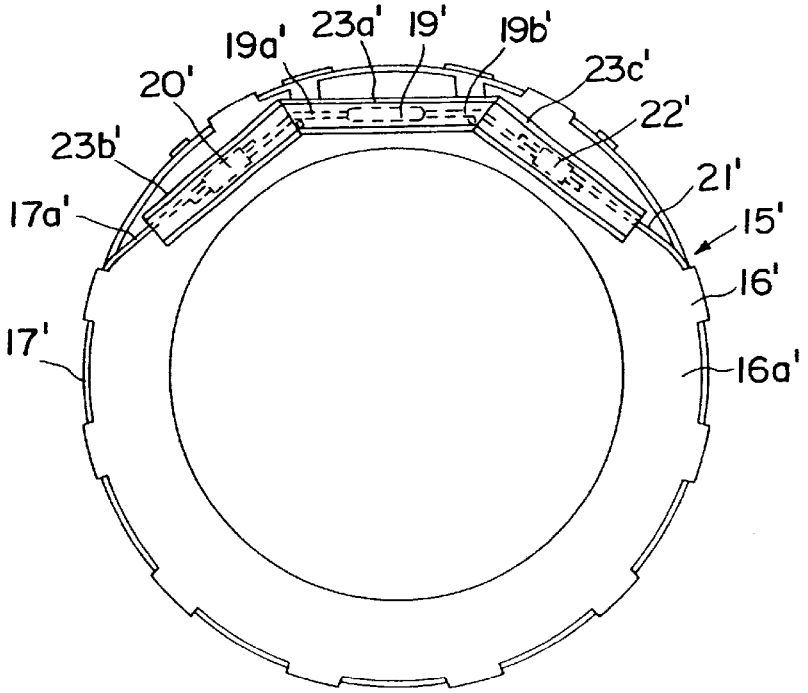
FIG. 7 is a plan view of a first end surface of a bobbin of an electromagnetic coil assembly, according to a second embodiment of the present invention.

Referring to FIG. 7, an electromagnetic coil assembly of a second embodiment of the present invention is shown. In an electromagnetic coil assembly 15', a thermal protection device 19', a first caulking terminal 20', a second caulking terminal 22', a first lead 19*a*' and a second lead 19*b*' of thermal protection device 19', a wire end portion 17*a*' of an electrical wire 17' adjacent to first caulking terminal 20', and a third lead 21', which is connected to the external power source (not shown) and is adjacent to second caulking terminal 22', are covered by securing members 23*a*', 23*b*', and 23*c*', each having groove-shaped cross-sections. The remaining structure of electromagnetic coil assembly 15' is substantially the same as electromagnetic coil assembly 15. In the electromagnetic coil assembly according to the second embodiment of present invention, thermal protection device 19', first caulking terminat 20', second caulking terminal 22', first lead 19*a*' and second lead 19*b*' of thermal protection device 19', wire end portion 17*a*' of electrical wire 17', and third lead 21' are substantially covered by securing members 23*a*', 23*b*', and 23*c*'. Therefore, after electromagnetic coil assembly 15' is fixed within the core ring by using resin, the exposure of thermal protection device 19', first caulking terminal 20', and second caulking terminal 22' from the resin bath may be reduced or effectively eliminated.

Figure 8:
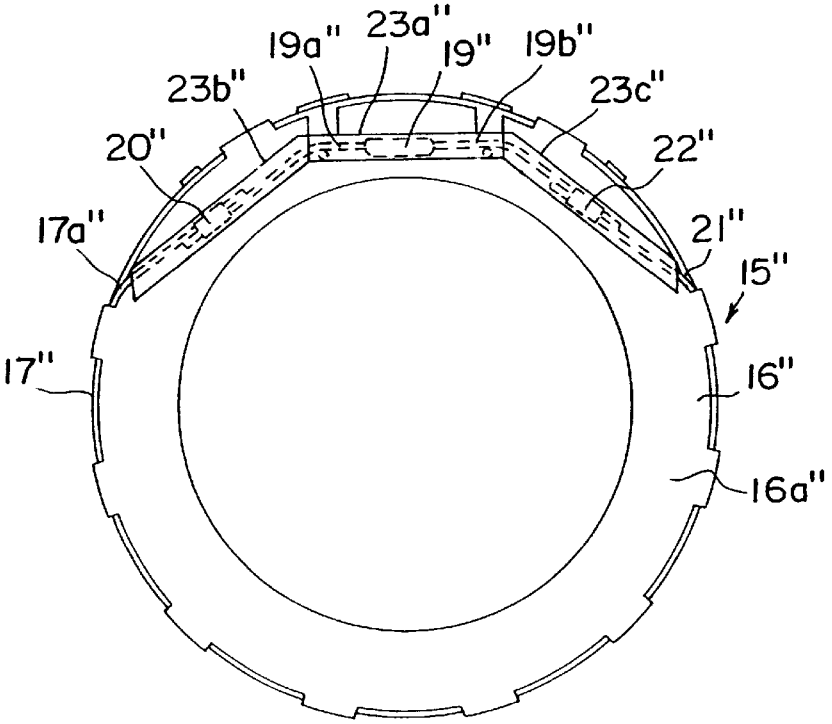
FIG. 8 is a plan view of a first end surface of a bobbin of an electromagnetic coil assembly, according to a third embodiment of the present invention.
Figure 9A:
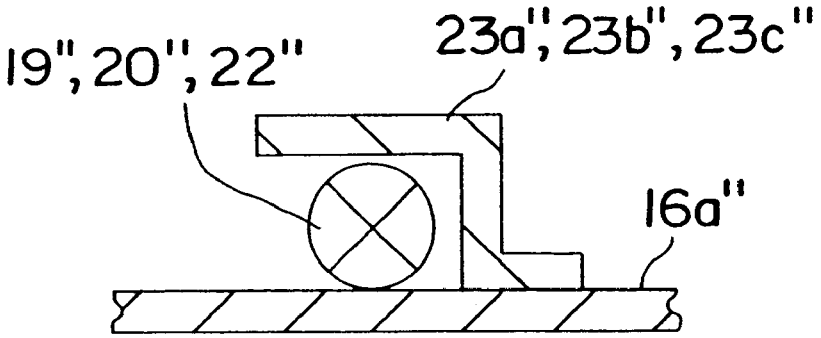
FIGS. 9*a*–9*c* are a cross-sectional view of securing members depicted in FIG. 8.
Figure 9B:
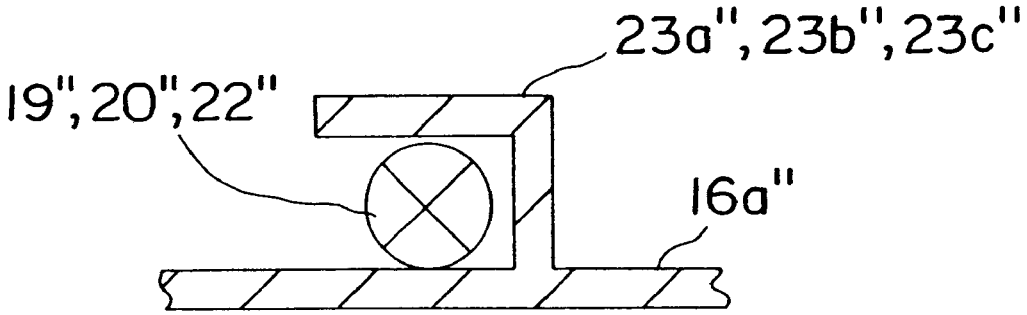
Figure 9C:
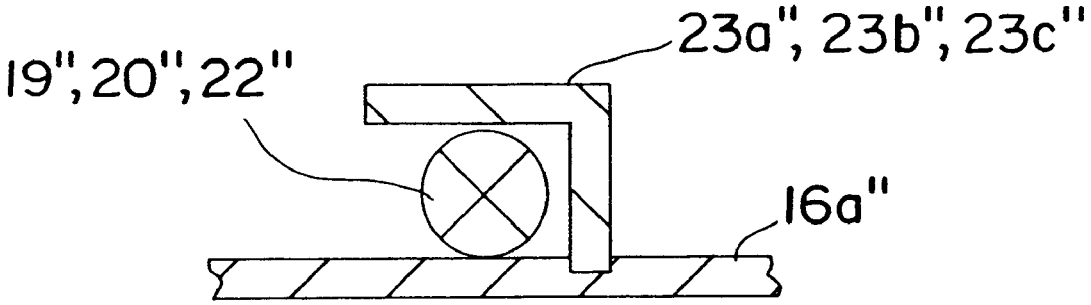

Referring to FIGS. 8, 9*a* to 9*c*, an electromagnetic coil assembly of a third embodiment of the present invention is shown. In an electromagnetic coil assembly 15", each of securing members 23*a*", 23*b*", and 23*c*" has a hook-shaped cross-section and is welded securely on a first end surface 16*a*" of a bobbin 16", as shown in FIG. 9*a*; is integrally molded with first end surface 16*a*" of bobbin 16", as shown in FIG. 9*b*; or is fitted pressedly on first end surface 16*a*" of bobbin 16", as shown in FIG. 9*c*. A thermal protection device 19", a first caulking terminal 20", a second caulking terminal 22", a first lead 19*a*" and a second lead 19*b*" of thermal protection device 19", a wire end portion 17*a*" of an electrical wire 17" adjacent to first caulking terminal 20", and a third lead 21", which is connected to the external power source (not shown) and is adjacent to second caulking terminal 22", are substantially covered by securing members 23*a*", 23*b*", and 23*c*".

The structure of electromagnetic coil assembly 15" is substantially the same as electromagnetic coil assembly 15' except that securing members 23*a*", 23*b*", and 23*c*" are used instead of securing members 23*a*', 23*b*', and 23*c*', and are molded, e.g., integrally molded, with first end surface 16*a*" of bobbin 16". In the electromagnetic coil assembly according to the third embodiment of present invention, thermal protection device 19", first caulking terminal 20", second caulking terminal 22", first lead 19*a*" and second lead 19*b*" of thermal protection device 19", wire end portion 17*a*" of electrical wire 17", and third lead 21" are substantially covered by securing members 23*a*", 23*b*", and 23*c*". Therefore, after electromagnetic coil assembly 15" is fixed within the core ring by using resin, the exposure of thermal protection device 19", first caulking terminal 20", and second caulking terminal 22" from the resin bath may be reduced or effectively eliminated.

Figure 10:
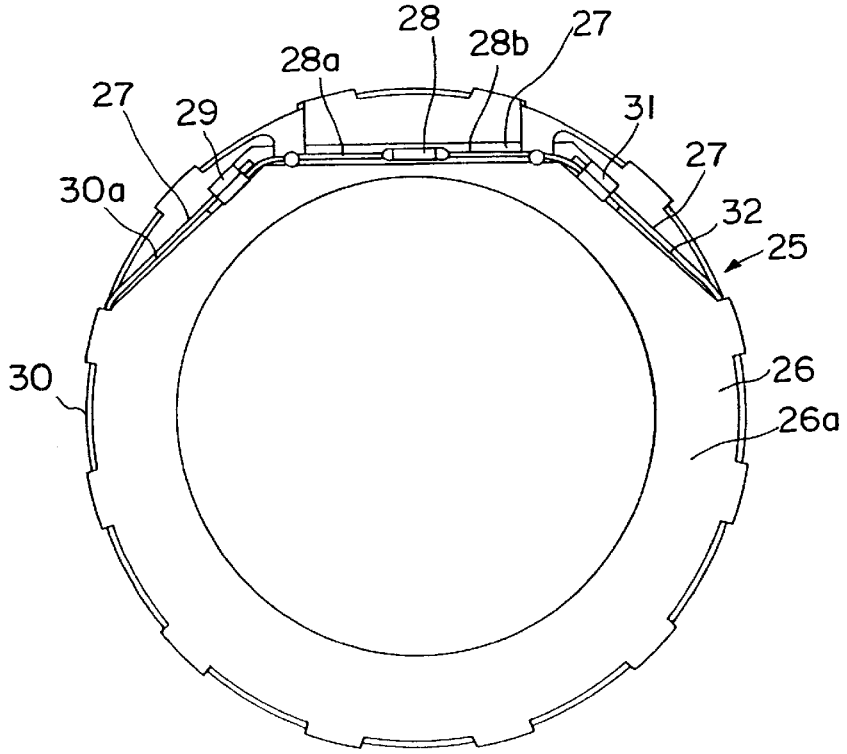
FIG. 10 is a plan view of a first end surface of a bobbin of an electromagnetic coil assembly, according to a fourth embodiment of the present invention.

Referring to FIG. 10, an electromagnetic coil assembly of a fourth embodiment of the present invention is shown. In an electromagnetic coil assembly 25, a groove 27 is formed on a first end surface 26*a* of a bobbin 26. A thermal protection device 28; a first lead 28*a* and a second lead 28*b* of thermal protection device 28; a first caulking terminal 29; a wire end portion 30*a* of an electrical wire 30 adjacent to first caulking terminal 29; a second caulking terminal 31; and a third lead 32, which is connected to the external power source (not shown) and is adjacent to second caulking terminal 31; are disposed in groove 27. The structure of electromagnetic coil assembly 25 is substantially the same as electromagnetic coil assembly 15" except that groove 27 is formed instead of securing 23*a*", 23*b*", and 23*c*".

In the electromagnetic coil assembly according to the fourth embodiment of present invention, thermal protection device 28, first lead 28*a*, second lead 28*b*, first caulking terminal 29, wire end portion 30*a* of electrical wire 30, second caulking terminal 31, and third lead 32 are disposed in groove 27. Therefore, after electromagnetic coil assembly 25 is fixed within the core ring by using resin, the wear resistance between thermal protection device 28, first caulking terminal 29, second caulking terminal 31 and both side walls of groove 27 may prevent thermal protection device 28, first caulking terminal 29, and second caulking terminal 31 from exposuring from the resin bath.

Figure 11:
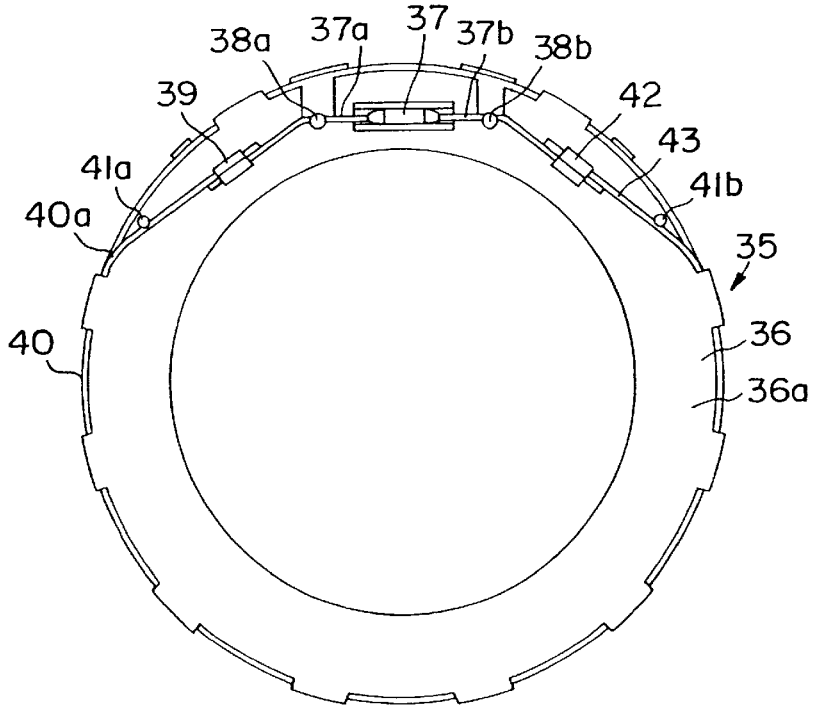
FIG. 11 is a plan view of a first end surface of a bobbin of an electromagnetic coil assembly, according to a fifth embodiment of the present invention.

Referring to FIG. 11, an electromagnetic coil assembly of a fifth embodiment of the present invention is shown. In an electromagnetic coil assembly 35, each of projection portions 38*a* and 38*b* has a hook shape and is molded, e.g. integrally molded, with a first end surface 36*a* of a bobbin 36. Projection portion 38*a* is adjacent to a starting end portion of a first lead 37*a* of a thermal protection device 37. Projection portion 38*b* is adjacent to a starting end portion of a second lead 37*b* of thermal protection device 37. Each of projection portions 41*a* and 41*b* has a hook shape and is molded, e.g., integrally molded, with first end surface 36*a* of bobbin 36. Projection portion 41*a* retains wire end portion 40*a* of electrical wire 40 adjacent to first caulking terminal 39. Projection portion 41*b* retains a third lead 43, which is connected to the external power source (not shown), adjacent to second caulking terminal 42. Wire end portion 40*a* of electrical wire 40 adjacent to first caulking terminal 39 and first lead 37*a* of thermal protection device 37 overlap and are secured to projection portions 41*a* and 38*a*, which are adjacent to each other, respectively. Third lead 43 adjacent to second caulking terminal 42 and second lead 37*b* of thermal protection device 37 overlap and are secured to projection portions 41*b* and 38*b*, which are adjacent to each other, respectively. The structure of projection portions 38*a*, 38*b*, 41*a*, and 41*b* is substantially the same as projection portions 24*a* and 24*b* in FIG. 6. The structure of electromagnetic coil assembly 35 is substantially the same as the known electromagnetic coil assembly except as described above.

In this embodiment of electromagnetic coil assembly 35, adjacent portions of starting end portions of first lead 37*a* and second lead 37*b* of thermal protection device 37 are secured to projection portions 38*a* and 38*b*, respectively. The distance between projection portion 38*a* and projection portion 38*b* is reduced or minimized. Therefore, the upward force on thermal protection device 37 created by the resin, which is poured into the spaces between projection portions 38*a* and 38*b* and first end surface 36*a*, may be reduced or eliminated. As a result, after electromagnetic coil assembly 35 is fixed within the core ring by using resin, the exposure of thermal protection device 37 from the resin bath may be reduced or eliminated. Further, projection portion 41*a*, which retains wire end portion 40*a* of electrical wire 40 adjacent to first caulking terminal 39, and projection portion 41*b*, which retains lead 43 adjacent to second caulking terminal 42, are disposed on first end surface 36*a* in addition to projection portions 38*a* and 38*b*. Therefore, after electromagnetic coil assembly 35 is fixed within the core ring by using resin, the exposure of thermal protection device 37, first caulking terminal 39, and second caulking terminal 42 from the resin bath may be reduced or effectively eliminated. Further, wire end portion 40*a* of electrical wire 40 adjacent to first caulking terminal 39 and first lead 37*a* of thermal protection device 37 overlap and are secured to projection portions 41*a* and 38*a*, respectively. Lead 43 adjacent to second caulking terminal 42 and second lead 37*b* of thermal protection device 37 overlap and are secured to projection portions 41*b* and 38*b*, respectively. Consequently, after electromagnetic coil assembly 35 is fixed within the core ring by using resin, the exposure of thermal protection device 37, first caulking terminal 39, and second caulking terminal 42 from the resin bath may be reduced or effectively eliminated.

Figure 12:
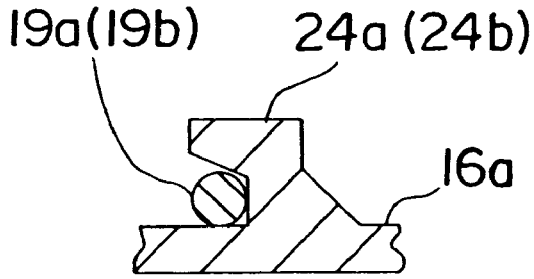
FIG. 12 is a cross-sectional view of one deformation embodiment of projection portions depicted in FIG. 4.

In the above-described embodiments, the unification of securing members 23*a*', 23*b*', and 23*c*' of FIG. 7 is within the contemplation of the present invention. Referring to FIG. 12, one deformation embodiment of the first embodiment of the present invention, an engagement portion of projection portions 24*a* and 24*b*, first lead 19*a*, and second lead 19*b*, is shown. It is desirable to gradually reduce the height of the engagement portion above first end surface 16*a* towards the inner part of the engagement portion. In this embodiment, when first lead 19*a* and second lead 19*b* are engaged in projection portions 24*a* and 24*b*, first lead 19*a* and second lead 19*b* are guided to the inner part of the engagement portion and are pressed on first end surface 16*a*. As a result, after electromagnetic coil assembly 15 is fixed within the core ring by using resin, the exposure of thermal protection devices 19, first caulking terminal 20, and second caulking terminal 22 from the resin bath may be reduced or effectively eliminated.

Figure 13:
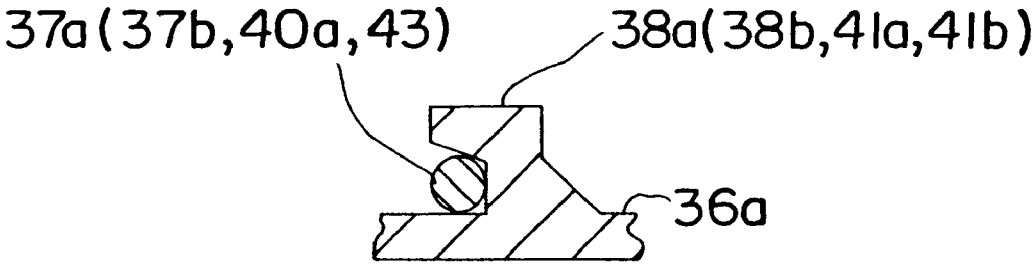
FIG. 13 is a cross-sectional view of one deformation embodiment of projection portions depicted in FIG. 11.

Further, the unification of securing members 23*a*", 23*b*", and 23*c*" of FIG. 8 is also within the contemplation of the present invention. Referring to FIG. 13, one deformation embodiment of the fifth embodiment of the present invention, an engagement portion of projection portions 38*a*, 38*b*, 41*a*, and 41*b*, and first lead 37*a* and second lead 37*b*, wire end portion 40*a* of electrical wire 40, and third lead 43, is shown. It is desirable to gradually reduce the height of the engagement portion above first end surface 36*a* towards the inner part of the engagement portion. In this embodiment, when first lead 37*a* and second lead 37*b*, wire end portion 40*a* of electrical wire 40, and third lead 43 are engaged in projection portions 38*a*, 38*b*, 41*a*, and 41*b*; and first lead 37*a*, and second lead 37*b*; and wire end portion 40*a* of electrical wire 40; and third lead 43 are guided to the inner part of the engagement portion and are pressed on first end surface 36*a*. As a result, after electromagnetic coil assembly 35 is fixed within the core ring by using resin, the exposure of thermal protection devices 37, first caulking terminal 39, and second caulking terminal 42 from the resin bath may be reduced or effectively eliminated.

As described above, in the embodiments of the present invention of an electromagnetic coil assembly, securing members having groove-shaped cross-sections, which are welded securely on a first end surface of a bobbin, or which are fitted pressedly on the first end surface of the bobbin, cover a thermal protection device, a first caulking terminal, and a second caulking terminal. Therefore, after the electromagnetic coil assembly is fixed within the core ring by using resin, the exposure of the thermal protection device, the first caulking terminal, and the second caulking terminal from resin bath may be reduced or effectively eliminated.

Although the present invention has been described in connection with preferred embodiments, the invention is not limited thereto. It will be understood by those skilled in the art that variations and modifications may be made within the scope and spirit of this invention, as defined by the following claims.

What is claimed is:

1. An electromagnetic coil assembly for an electromagnetic apparatus comprising:

a bobbin including a cylindrical tubular spool and a pair of annular flanges projecting radially from said spool;

a coil formed of an electrical wire, said electrical wire wound around said spool between said flanges;

a thermal protection device having a first and a second lead wires, each extending from one side thereof, said first lead wire connected to one end of said electrical wire through a first connecting member, said second lead wire connected to one end of a third lead wire of an electric circuit through a second connecting member, said thermal protection device, said first lead wire, said second lead wire, said first connecting member, said second connecting member, one end of said electrical wire, one end of said third lead wire disposed on a first end surface of said bobbin; and a first pair of projection portions, a first projection portion and a second projection portion, each having a hook-shaped cross-section and disposed on said first end surface of said bobbin, such that said first projection portion retains a starting end portion of said first lead wire and said second projection portion retains a starting end portion of said second lead wire.

2. The electromagnetic coil assembly of claim 1, wherein a second pair of projection portions, a third projection portion and a fourth projection portion, each having a hook-shaped cross-section, are disposed on said first end surface of said bobbin, such that said third projection portion retains said electrical wire adjacent to said first connecting member and said fourth projection portion retains said third lead wire adjacent to said second connecting member.

3. The electromagnetic coil assembly of claim 1, wherein said starting end portion of said first lead wire and said electrical wire adjacent to said first connecting member overlap and are secured to said first projection portion and said third projection portion, respectively, and wherein said starting end portion of said second lead wire and said third lead wire adjacent to said second connecting member overlap and are secured to said second projection portion and said fourth projection portion, respectively.

4. The electromagnetic coil assembly of claim 1, wherein said first pair of projection portions are integrally molded with said first end surface of said bobbin, and have a cross-sectional thickness which gradually increases towards its base.

5. The electromagnetic coil assembly of claim 2, wherein said second pair of projection portions are integrally molded with said first end surface of said bobbin, and have a cross-sectional thickness which gradually increases towards its base.

6. The electromagnetic coil assembly of claim 1, wherein said first pair of projection portions are integrally molded with said first end surface of said bobbin, and have engagement portions to said first and second lead wires the heights of which gradually decreases from said first end surface to inner parts of said engagement portions.

7. The electromagnetic coil assembly of claim 2, wherein said second pair of projection portions are integrally molded with said first end surface of said bobbin, and have engagement portions to said electrical wire and said third lead wire the heights of which gradually decreases from said first end surface to inner part of said engagement portions.

* * * * *